US008409361B2

(12) United States Patent
Kim et al.

(10) Patent No.: US 8,409,361 B2
(45) **Date of Patent: *Apr. 2, 2013**

(54) CONTROLLING METHOD OF DISHWASHER

(75) Inventors: Seong Ho Kim, Seoul (KR); Yong Jin Choi, Seoul (KR); Young Hwan Park, Seoul (KR)

(73) Assignee: LG Electronics Inc., Seoul (KR)

( * ) Notice: Subject to any disclaimer, the term of this patent is extended or adjusted under 35 U.S.C. 154(b) by 313 days.

This patent is subject to a terminal disclaimer.

(21) Appl. No.: 12/461,679

(22) Filed: Aug. 20, 2009

(65) Prior Publication Data

US 2010/0043833 A1 Feb. 25, 2010

(30) Foreign Application Priority Data

Aug. 21, 2008 (KR) ..... 10-2008-0081798

(51) Int. Cl.
*B08B 3/02* (2006.01)
*B08B 3/04* (2006.01)

(52) U.S. Cl. ..... 134/25.2; 134/19; 134/30; 134/56 D

(58) Field of Classification Search ..... 134/19, 134/25.2, 56 D
See application file for complete search history.

(56) References Cited

U.S. PATENT DOCUMENTS

| | | | | |
|---|---|---|---|---|
| 3,072,128 | A * | 1/1963 | James | 134/57 D |
| 4,179,821 | A * | 12/1979 | Herbst et al. | 34/235 |
| 2007/0102026 | A1 * | 5/2007 | Ahn et al. | 134/25.2 |
| 2008/0190453 | A1 * | 8/2008 | Hildenbrand | 134/18 |

FOREIGN PATENT DOCUMENTS

| | | | |
|---|---|---|---|
| CN | 2282855 | Y | 6/1998 |
| CN | 2379092 | Y | 5/2000 |
| CN | 101049224 | A | 10/2007 |
| CN | 101161186 | A | 4/2008 |
| EP | 1738677 | A2 | 1/2007 |
| JP | 10286212 | A * | 10/1998 |
| JP | 11206681 | A * | 8/1999 |

OTHER PUBLICATIONS

Derwent abstract JP11206681; Nakano et al., 1999.*
Derwent abstract JP10286212; Kajiwara et al., 1998.*

* cited by examiner

*Primary Examiner* — Michael Kornakov
(74) *Attorney, Agent, or Firm* — McKenna Long & Aldridge LLP

(57) ABSTRACT

Dishwashers and methods of control for operation of dishwashers are disclosed. The operation of the dishwasher can include a drying cycle which uses a steam generator to supply steam to heat a washing compartment. The steam can evaporate moisture on the dishes in the washing compartment. When a condition of the dishwasher is met, such as a temperature or operation time meeting a preset value, an exhaust fan may exhaust air from inside the washing compartment. The operation of the dishwasher can improve power consumption and dry dishes more efficiently.

13 Claims, 3 Drawing Sheets

CONTROLLING METHOD OF DISHWASHER

CROSS REFERENCE TO RELATED APPLICATION

This application claims the benefit of Korean Patent Application No. 10-2008 0081798, filed on Aug. 21, 2008, which is hereby incorporated by reference as if fully set forth herein.

BACKGROUND OF THE DISCLOSURE

1. Field of the Disclosure

The present disclosure generally relates to dishwashers. In particular, the present disclosure relates to controls for a dishwasher which improve washing efficiency when dishes are dried.

2. Discussion of the Related Art

A conventional dishwasher is a machine that sprays washing water on dishes placed in a tub to remove foreign matter, such as food scraps left on the dishes. Generally, the dishwasher is operated based on a washing cycle which sprays washing water mixed with detergent in a tub that contains dishes, in order to remove foreign matter left on the dishes. The dishwasher may also heat the washing water to improve performance. Typically, after the washing cycle, a rinsing cycle occurs which sprays washing water that is not mixed with the detergent in the tub to remove any remaining foreign matter. After the washing cycle, a drying cycle takes place that dries the dishes.

Typically, more than one spraying arm and at least one rack (for placing dishes which need to be washed) are provided in a single tub of the conventional dishwasher. For example, a dishwasher usually has an upper rack and a lower rack in a bi-level configuration within the tub. A number of holders are then provided on the upper rack that holds small dishes, such as small cups with a small washing load, and a smaller number of holders are provided on the lower rack that holds large dishes, such as dinner dishes or large bowls with a larger washing load. An upper spraying arm and a lower spraying arm are then provided which spray washing water at the upper and lower racks, respectively.

The operation of a conventional dishwasher, including the wash, rinse, and dry cycles are usually performed sequentially. During the drying cycle, air is heated by a heater provided inside the dishwasher and supplied to a washing compartment of the dishwasher. The heated air typically dries dishes that remain wet after the washing and rinsing cycles by evaporating water remaining on the dishes. The moist air inside the washing compartment is then exhausted outside of the dishwasher. Unfortunately, this conventional mode of operating a dishwasher is inefficient. For example, the above described drying cycle of the dishwasher consumes a large amount of energy.

SUMMARY OF THE DISCLOSURE

The present disclosure generally relates to a dishwasher which improves washing efficiency and methods of control and operation of the dishwasher. In an embodiment, the dishwasher can include a steam generator that generates steam to dry dishes more efficiently during a drying cycle, for example. The dishwasher may not include a heater, such as an auxiliary heater, to dry dishes.

Advantages and features of the disclosure in part may become apparent in the description which follows and in part may become apparent to those having ordinary skill in the art upon examination of the following or may be learned from practice of the invention. The advantages of embodiments of the present disclosure may be realized and attained by the structures and processes described in the written description, the claims, and in the appended drawings.

To achieve these and other advantages and in accordance with the purpose of the present disclosure, as embodied and broadly described herein, a controlling method of a dishwasher including a washing compartment, a sump configured to contain water, a steam generator, and at least one spraying arm is provided. The method can comprise performing a washing cycle including supplying steam to the washing compartment and spraying water to at least one rack provided in the washing compartment, the supplying steam and the spraying water being repeated alternately for a preset time period; rinsing by spraying water toward the rack; and drying including heating air inside the washing compartment and exhausting the heated air of the washing compartment.

In some embodiments, the heating in the drying may be performed before the drying is exhausted. The heating in the drying may also be performed by supplying steam generated at the steam generator to the washing compartment. The supplying steam in the performing of the washing cycle may be performed for more than 15 minutes.

The heating in the drying may be performed until a temperature of the washing compartment reaches a preset first temperature. The first temperature may be between 63° C. and 67° C. The supplying steam in the performing of the washing cycle may be performed more than three times and for more than 3 minutes. The spraying water may be continued for a preset time period after the supplying steam and the spraying water in the performing of the washing cycle are repeated alternatively for the preset time period.

In an embodiment, a controlling method of a dishwasher including a washing compartment, a sump adapted to contain water, a steam generator and at least one spraying arm is provided. The controlling method can include performing a washing cycle including supplying steam to the washing compartment and spraying water toward at least one rack provided in the washing compartment, the supplying steam and the spraying water being repeated alternately; and drying including supplying steam to the washing compartment and exhausting air inside the washing compartment. The supplying of the steam in the drying may be performed for more than 15 minutes. In addition, the supplying steam in the drying may be performed continuously until the temperature of the heated air inside the washing compartment is between 63° C. and 67° C.

Exemplary embodiments of a controlling method of a dishwasher including a washing compartment, a sump configured to contain water, a steam generator, and at least one spraying arm are provided. The controlling method can include performing a washing cycle including spraying steam to the washing compartment and spraying water to the washing compartment, the spraying steam and the spraying water being repeated alternately for a preset time period; and drying by dehumidifying an inside of the washing compartment after increasing a temperature and humidity inside of the washing compartment. The increasing of the temperature and humidity may be in the drying performed by supplying steam generated at the steam generator to the washing compartment. The steam may be supplied to the washing compartment by the steam generator until the temperature of the air inside the washing compartment between 63° C. and 67° C. in the drying.

According to embodiments of the present disclosure, a dishwasher having improved efficiency is provided. The dishwasher can use steam to dry dishes provided in a washing compartment of the dishwasher. In addition, the dishwasher may not include a heater to heat air inside the washing compartment. Advantageously, the drying cycle of the dishwasher can be more energy efficient.

It is to be understood that both the foregoing general description and the following detailed description are exemplary and explanatory and should not be construed as limiting the scope of the claims.

BRIEF DESCRIPTION OF THE DRAWINGS

The accompanying drawings are included to provide a further understanding of the disclosure, and are incorporated herein and constitute a part of this application. The drawings together with the description serve to explain exemplary embodiments of the present disclosure. In the drawings.

DESCRIPTION OF THE EMBODIMENTS

Reference will now be made in detail to the specific embodiments of the present disclosure, examples of which are illustrated in the accompanying drawings. Wherever possible, the same reference numbers will be used throughout the drawings to refer to the same or like parts.

Figure 1:
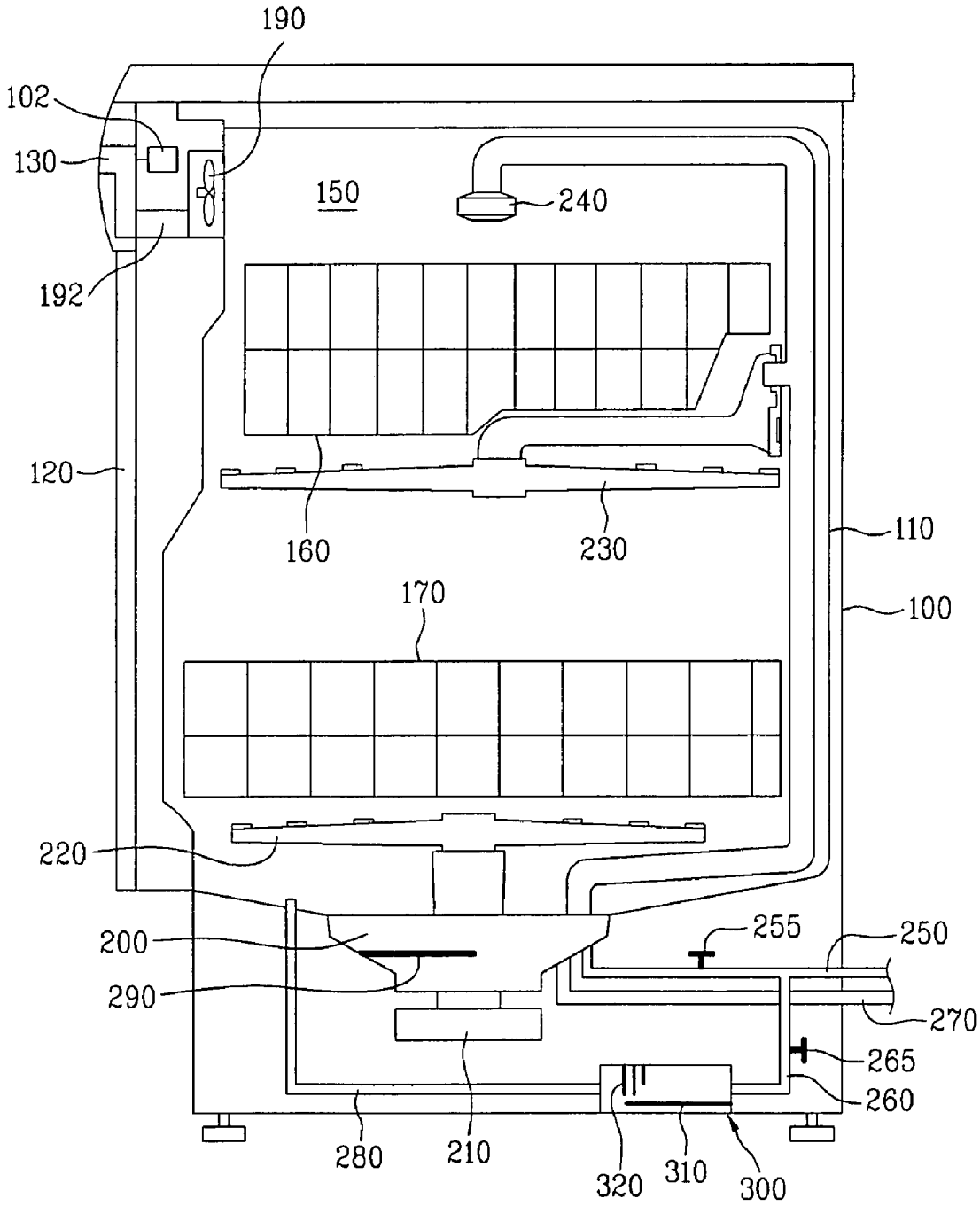
FIG. 1 illustrates a sectional view of a dishwasher and controls, according to an embodiment of the invention.

FIG. 1 depicts a sectional view of a dishwasher and controls, according to an embodiment of the invention. The dishwasher can include a case 100 which defines an exterior appearance, a door 120 for opening and closing the case 100, and a control panel 130 mounted on the case 100 or door 120 for operating the dishwasher. The case 100 may include a washing compartment 150 having a tub 110. Dishes can be placed in the washing compartment 150.

In an embodiment, a sump 200 can be positioned under the tub 110 which holds washing water. A pump 210 and a filter (not shown) can be provided in the sump 200. The pump 210 can pump the washing water held in the sump 200. The filter can advantageously filter contaminated water. In addition, a sump heater 290 may be provided in the sump 200 to heat water inside the sump 200.

With continued reference to FIG. 1, a first water supply pipe 250 and a water drain pipe 270 can be connected with the sump 200. New clean water may be drawn from an external water source through the first water supply pipe 250 and the washing water inside the sump 200 can be drained outside through the water drain pipe 270. A first water supply valve 255 can be installed at the first water supply pipe 250 to control the supply of the water to the sump 200.

In some embodiments, at least one rack and spraying arm may be provided in the tub 110, such as inside the washing compartment 150, for example. When dishes are placed on the rack, the pump 210 pumps water and the spraying arm sprays the pumped water toward the rack. As shown, an upper rack 160 and a lower rack 170 can be disposed in an upper portion and a lower portion of the washing compartment 150, respectively. In addition, an upper spraying arm 230 and a lower spraying arm 220 can then be placed near the upper rack 160 and the lower rack 170 to spray the water pumped by the pump 210 at each respective rack. Washing compartment 150 may also include a top nozzle 240 in its upper portion to spray the water pumped by the pump 210 downward.

Dishwasher may include a steam generator 300 to supply steam to the washing compartment 150. Washing water may be circulated in the washing compartment 150 using the pump 210, and, for example, the lower spraying arm 220 and/or upper spraying arm 230. In some embodiments, steam generator 300 can be operated separately from the sump heater 290. As shown, the steam generator 300 may be in communication with the first water supply pipe 250. The steam generator 300 may be in communication with the washing compartment 150 via a steam supply pipe 280. A second water supply valve 265 may be installed at a second water supply pipe 260 to control the supply of the water to the steam generator 300.

Steam generator 300 can include a steam heater 310 for heating the water supplied to the steam generator 300 and a water level sensor 320 for sensing a water level inside the steam generator 300. The water level sensor 320 may sense a low level and a high level of water, for example. The low level can be predetermined or set to protect the steam heater 310 of the steam generator 300 and the high level can be predetermined or set to prevent the water supplied to the steam generator 300 from overflowing. In addition, the steam generator 300 may include a steam supply valve (not shown) for controlling the opening and closing of the steam supply pipe 280 so that the steam can be supplied to the washing compartment 150 at various times or intervals.

The sump 200 may include a pollution level sensor (not shown) in a predetermined portion of the sump 200, which measures a pollution level of the washing water circulated in the tub 110, for example. In an embodiment, the door 120 may include an exhaust fan 190 and an exhaust duct 192 to exhaust damp air from the washing compartment 150. In some embodiments, a control unit 102, which controls the dishwasher, may be operationally connected with the control panel 130, the pump 210, and the steam generator 300.

The controller 102 may control the dishwasher in accordance with predetermined instructions stored in a memory (not shown). The controller 102 may be operationally coupled with at least the control panel 130, the washing pump 210, and the steam generator 300 so that they may be operated in accordance with a user's selection on the control panel 130.

A variety of operational modes may be predetermined in the dishwasher. For example, an operational mode of the dishwasher may be determined based on a user's selection or a type of a dish. In addition, the operational mode may be determined based on a pollution or contamination level of a dish. Advantageously, when the operational mode(s) is determined, operating parameters, such as the number of rotations per minute of the motor or the amount of detergent can be selected based on the determined operational mode.

The method of controlling or operating the dishwasher may include performing a washing cycle (W), rinsing (R) cycle, and drying cycle. During the washing cycle (W), food scraps on the dishes can be removed. During the rinsing cycle (R), the dishes are rinsed. The rinsing cycle (R) may occur after the washing cycle (W). During the drying cycle, the moisture remaining on the dishes can be removed. In addition, smaller cycles may be performed within each of the washing, rinsing, or drying cycles and/or other cycles may be included.

Figure 2:
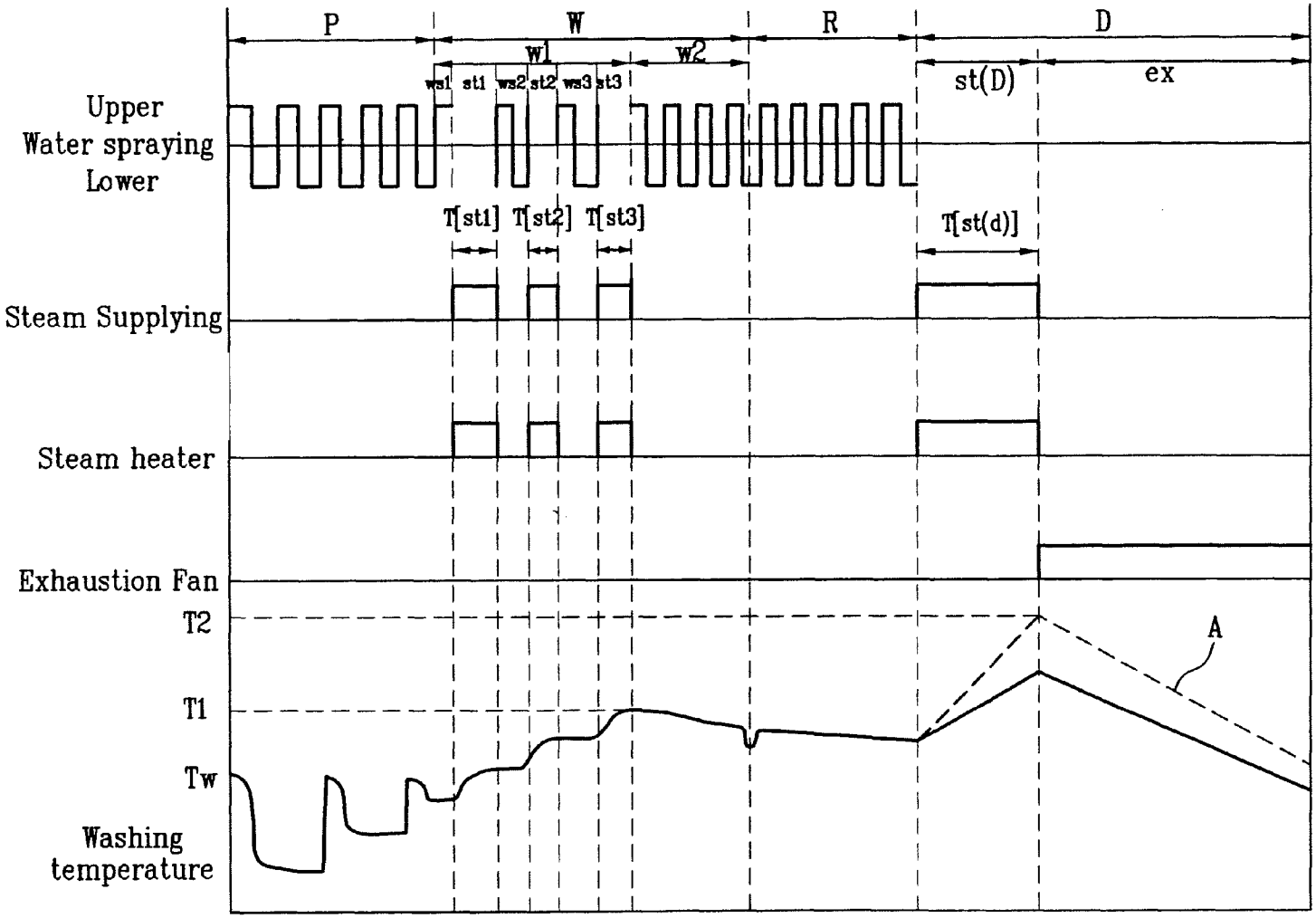
FIG. 2 illustrates overall operation of a dishwasher, according to an embodiment of the invention.

FIG. 2 illustrates overall operation of the dishwasher, according to an embodiment of the invention, including exemplary methods employed to control the operation of the dishwasher. Of note, the exemplary methods include performing a preliminary wash cycle (P), performing a main washing cycle (W), and a rinsing cycle (R).

During the preliminary washing cycle (P), the water supplied from an external water source can be sprayed on to dishes. An external water source may include a city or household water system connected to first water supply pipe 250, and may also include the sump 200. The supplied water may be cold, room temperature, or heated to a predetermined temperature to reduce the washing time. In FIG. 2, water temperature may be denoted as (Tw). The sump heater 290 may be used to heat the water. The preliminary washing cycle (P) may be used to remove primary food scraps from the dishes. Water may be supplied to the upper spraying arm 230 and the lower spraying arm 220 and sprayed alternately.

As further shown in FIG. 2, water spraying during the preliminary washing cycle (P) can include supplying water to the upper spraying arm 230 (hereinafter, "upper spraying") and supplying water to the lower spraying arm 220 (hereinafter, "lower spraying"). The water sprayed from the upper spraying arm 230 of the upper portion of the dishwasher may be sprayed toward the upper rack 160. The water sprayed from the lower spraying arm 220 of the lower portion of the dishwasher may be sprayed toward the lower rack 170. The upper and lower spraying can be repeated alternately for a preset time period. For example, the upper spraying and the lower spraying may be repeated alternately, each for a preset number of minutes. The number of minutes for each cycle of upper spraying may or may not equal the number of minutes for each cycle of lower spraying. Of note, alternating between upper and lower spraying can be used during the main washing cycle (W) and the rinsing cycle (R) as described in further detail herein.

The water used during the preliminary washing cycle (P) can be supplied from an external water supply source and may be cold or warm water. Warm water can be used to enhance washing efficiency or reduce washing time. In some embodiments, when the temperature of the water supplied is between approximately 40° C. and 50° C., the warm water can be heat-exchanged with the sump 200 and the temperature of the warm water may decrease. In addition, water may be supplied during the preliminary washing cycle (P) several times. As shown, when water is supplied during the preliminary washing cycle (P), the temperature of the water increases gradually. This can occur because the water supplied during the preliminary cycle may be heat-exchanged with the sump 200 to increase the temperature of the sump 200. As a result, the variation of temperature between the supplied water and the washing water can be reduced.

With continued reference to FIG. 2, after the preliminary washing cycle (P) is completed, the main washing cycle (W) may begin. During a primary period (w1) of the main washing cycle (W), water (ws1, ws2, ws3) and steam (st1, st2, st3) can be repeatedly supplied to satisfy a preset condition. The supplying of the water (ws1, ws2, and ws3) can be used to separate or wash foreign matter from the dishes and the supplying of the steam (st1, st2, and st3) can be used to soak the foreign matter stuck on surfaces of the dishes.

In addition, a steam generator 310, which generates steam, can be turned on and the sump heater 290 may be turned off during the supplying of the steam (st1, st2, st3). This can reduce electrical overload, or reduce the amount of power drawn by the dishwasher, when operating the steam generator 300 and the sump heater 290.

Of note, during the primary period (w1) of the main washing cycle water supplying can occur in intervals or stages (ws1, ws2, ws3) and steam supplying can occur in intervals or stages (st1, st2, st3) repeatedly until a preset condition, such as temperature of water in the sump, is satisfied. Because of the steam supplying, the temperature of the washing water can increase gradually (and without operation of the sump heater 290).

Although the water supplying (ws1, ws2, ws3) and the steam supplying (st1, st2, and st3) are depicted as being performed three times in the primary period (w1) of the main washing cycle (W), the number of times and period in which they occur is not limited thereto. For example, the number of occurrences of water supplying may be variable based on the alternation between upper and lower spraying. In addition, the supplying of the steam can be repeated several times during the primary period (w1) of the main washing cycle (W) to make the temperature of the washing water increase gradually. Also, as shown in FIG. 2 in an exemplary and non-limiting fashion, the upper spraying included in the supplying of the water may be performed one time and the lower spraying may be performed one time between the supplying of the steam period (st1, st2, st3). However, it should be appreciated that the number of times may vary even further.

In the illustrated embodiments, the supplying of the steam may be performed three times. Each operation time (T[st1], T[st2], T[st3]) of each period of the supplying of the steam (st1, st2, st3) can be at least 3 minutes. When the steam is supplied, the sump heater 290 may not be in a turned on state.

In some embodiments, the washing water can be heated until the temperature of the washing water reaches a preset first temperature (T1). Of note, the temperature of the washing water heated by the steam during the washing cycle (W) can be approximately 50° C. The first temperature (T1) can be selected based on a temperature condition and/or number of repetitions. More specifically, the preset first condition (T1) can be a temperature which water contained in the sump 200 reaches, a temperature which water heated by the sump heater 290 exceeds, or a time period during which upper and lower spraying occurs and/or repeats.

In an embodiment, when a preset condition is satisfied in the primary period (w1) of the washing cycle (W), period (w2) may begin. During period (w2) alternate repeating of upper and lower spraying can be performed by the upper spraying arm 230 and the lower spraying arm 220. Water can be sprayed by the upper spraying arm 230 and the lower spraying arm 220 alternately and for any number of repetitions. In addition, during period (w2) and/or another final period of the washing cycle (W), the sump heater 290 may or may not be operated. Of note, when the sump heater 290 is not in operation, the temperature of the washing water used in the washing cycle (W) may decrease gradually.

After the upper and lower spraying during period (w2) of the washing cycle (W) occurs, the washing water can be drained and/or new clean water can be supplied (hereinafter, "draining and supplying"). When the draining and supplying (DS) finishes, the rinsing cycle (R) can occur. During the rinsing cycle (R) the newly supplied water can be sprayed using the upper spraying arm 230 and the lower spraying arm 220 in an alternating manner, for example.

After the rinsing cycle (R), the drying cycle (D) may begin. In some embodiments, the drying cycle (D) may use steam to increase the temperature of the dishes in a primary period of the drying cycle (D). The steam generator 300 can be used to generate and supply steam to the washing compartment 150 during the primary period of the drying cycle (D).

The drying cycle (D) can include heating air inside the washing compartment 150 (st(D)) and exhausting the air to outside of the washing compartment 150 (ex) to dry the dishes. In some embodiments, the heating of the air inside the washing compartment 150 can be performed by supplying steam to the washing compartment (st(D)). The steam supplying can allow the moisture remaining on the dishes to evaporate.

The heating (st(D)) can be performed until the temperature inside the washing compartment reaches a preset second temperature (T2). Of note, water may be supplied to the steam generator 300 during the steam supplying of the heating (st (D)) period. In some embodiments, the heating (st(D)) can occur for approximately 15 (fifteen) minutes or more and/or the until preset second temperature (T2) may be reached. The operation time of heating the air inside the washing compartment by supplying steam to the washing compartment 150 is notated as T[st(D)].

The second temperature (T2) can be a temperature capable of removing moisture remaining on the dishes. For example, the second temperature (T2) can be between approximately 63° C. and 67° C. When the temperature of the washing compartment 150 reaches the preset second temperature (T2), air can be exhausted to outside the washing compartment 150 (ex) and the dishes can reach a state of being substantially dry. For example, the exhaust fan 190 can be rotated to exhaust the damp air inside the washing compartment 150 outside to dry the dishes.

With continued reference to FIG. 2, in the period of rinsing (R), temperature graph (A) (shown in dotted lines) illustrates exemplary embodiments of the temperature inside washing compartment 150 during heating (st(D)) and exhausting (ex). The temperature graph (shown in a solid line) below temperature graph (A) illustrates exemplary embodiments of the temperature of the sump 200 during heating (st(D)) and exhausting (ex). As shown, the temperature of the washing compartment 150 and sump 200 can rise quickly during the heating period (st(D)) and decrease quickly during the exhaust period (ex).

Figure 3:
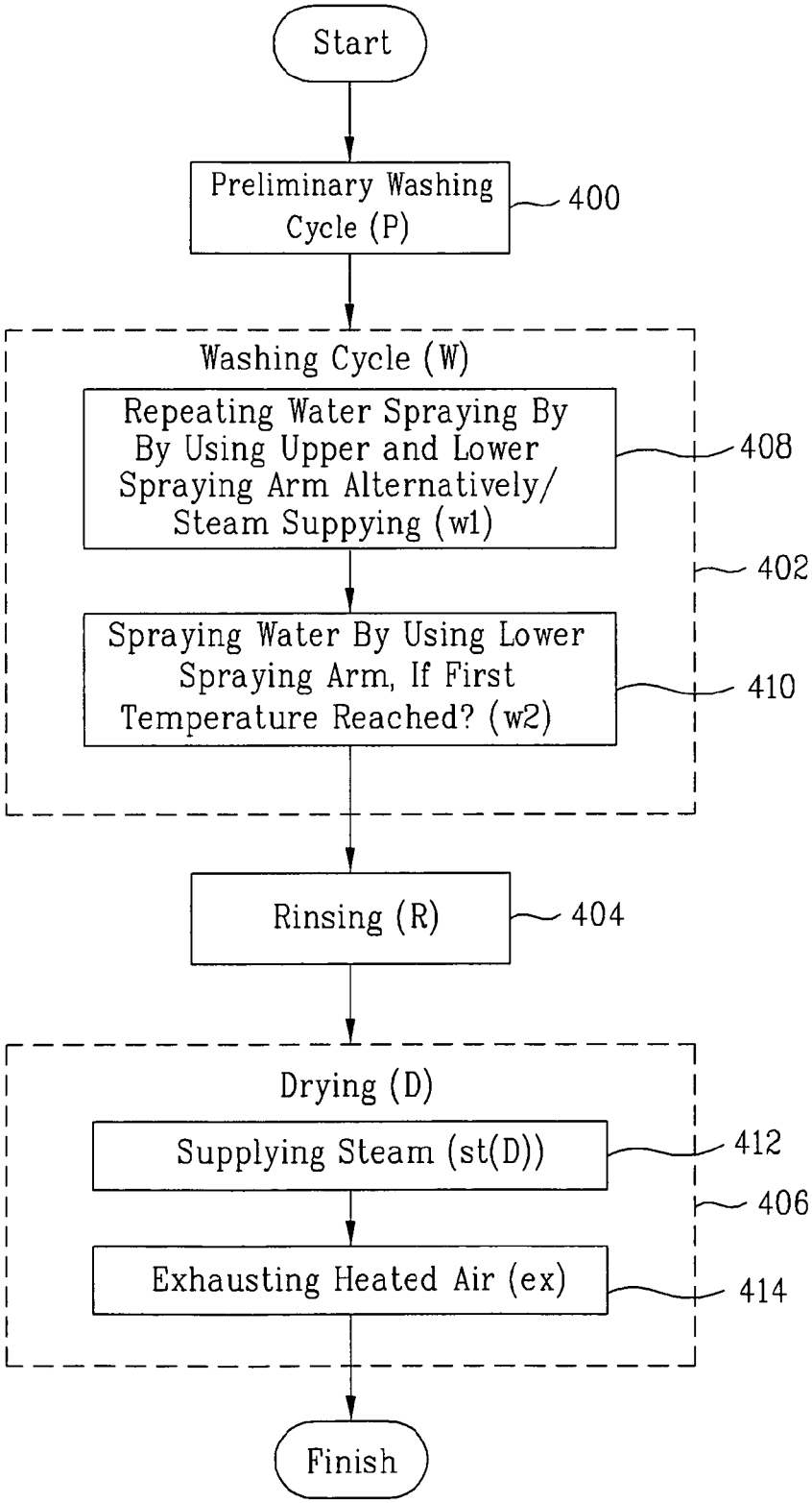
FIG. 3 illustrates an exemplary method that may be employed to control the dishwasher of FIG. 1, according to an embodiment of the invention.

FIG. 3 illustrates an exemplary method that may be employed to control the dishwasher of FIG. 1, according to an embodiment of the invention. Embodiments of the exemplary method can advantageously allow dishes to be washed efficiently. As shown, the methods can include performing a preliminary washing cycle (P) 400, a main washing cycle (W) 402, and a rinsing cycle (R) 404. In addition, the method may include a drying cycle (D) 406 in which the dishes contained in the washing compartment 150 can be dried.

The performing of the washing cycle (W) 402 can include period (w1) 408. During period (w1), the upper spraying arm 230 and/or the lower spraying arm 220 can repeatedly spray water in an alternating manner and steam can be supplied. This water spraying and steam supplying can occur at predetermined timings and/or until a condition occurs, such as a time period or temperature (T1) is reached.

In period (w2) 410 of the washing cycle (W), upper and/or lower spraying can occur repeatedly until a condition occurs, such as a time period or temperature is reached. Of note, steam may not be supplied during period (w2).

After the washing cycle (W) 402, the washing water can be drained and new water supplied to the dishwasher (not shown). Moving to the rinsing cycle (R) 404, the upper spraying arm 230 and the lower spraying arm 220 may spray water in an alternating manner.

Moving to the drying cycle (D) 406, during period (st(D)) 412 steam can be supplied by steam generator 300 to heat air inside the washing compartment 150. The supplied steam can evaporate water on the dishes in the washing compartment 150. The steam may be supplied until a preset condition occurs, such as a time period or temperature (T2) is reached. In period (ex) 414 of the drying cycle (D) 406, the moist air inside the washing compartment 150 can be exhausted outside the dishwasher by the exhaustion fan 190. Of note, an auxiliary heater is not needed during the drying cycle (D) 406, which can allow the dishwasher to operate more efficiently.

It will be apparent to those skilled in the art that various modifications and variations can be made in the present disclosure without departing from the spirit or scope of the disclosure. Thus, it is intended that the present disclosure cover any modifications and variations within the scope of the appended claims and their equivalents.

What is claimed is:

1. A controlling method of a dishwasher comprising a washing compartment, a sump configured to contain water, a steam generator, and at least one spraying arm, the method comprising:

performing a washing cycle including supplying steam to the washing compartment, spraying water to at least one rack provided in the washing compartment, the supplying steam and the spraying water being repeated alternately for a preset time period until a temperature of water in the sump reaches a preset first temperature, and further spraying water to the at least one rack without supplying steam after the preset first temperature is reached;

rinsing by spraying water toward the rack after the washing cycle is completed; and drying including heating air inside the washing compartment and exhausting the heated air from the washing compartment, wherein the heating is performed by supplying steam generated at the steam generator to the washing compartment, and the exhausting is performed by rotating an exhaust fan installed in the dishwasher.

2. The controlling method of claim 1, wherein the heating is performed before the exhausting in the drying.

3. The controlling method of claim 1, wherein the supplying steam in the heating is performed for more than 15 minutes.

4. The controlling method of claim 1, wherein the heating in the drying is performed until a temperature of the washing compartment reaches a preset second temperature.

5. The controlling method of claim 4, wherein the second temperature is between 63° C. and 67° C.

6. The controlling method of claim 1, wherein the supplying steam in the performing of the washing cycle is performed more than three times for more than 3 minutes.

7. The controlling method of claim 6, wherein the spraying water is continued for a preset time period after the supplying steam and the spraying water in the performing of the washing cycle is repeated alternately for the preset time period.

8. A controlling method of a dishwasher comprising a washing compartment, a sump configured to contain water, a steam generator and at least one spraying arm, the controlling method comprising:

performing a washing cycle including supplying steam to the washing, spraying water to at least one rack provided in the washing compartment, the supplying steam and the spraying water being repeated alternately until a temperature of water in the sump reaches a preset first temperature, and further spraying water to the at least one rack without supplying steam after the preset first temperature is reached; and drying including supplying steam to the washing compartment and exhausting air inside the washing compartment from the washing compartment, wherein the exhausting is performed by rotating an exhaust fan installed in the dishwasher.

9. The controlling method of claim 8, wherein the supplying steam in the drying is performed for more than 15 minutes.

10. The controlling method of claim 8, wherein the supplying steam in the drying is performed continuously until the temperature of the air inside the washing compartment is between 63° C. and 67° C.

11. A controlling method of a dishwasher comprising a washing compartment including a sump configured to contain water, a steam generator, and at least one spraying arm, the controlling method comprising:

performing a washing cycle comprising spraying steam to the washing compartment, spraying water to the washing compartment, the spraying steam and the spraying water being repeated alternately for a preset time period until a temperature of water in the sump reaches a preset first temperature, and further spraying water to the washing compartment without supplying steam after the preset first temperature is reached; and drying including increasing a temperature and humidity inside the washing compartment and dehumidifying an inside of the washing compartment after the increasing the temperature and the humidity, wherein the dehumidifying is performed by rotating an exhaust fan installed in the dishwasher.

12. The controlling method of claim 11, wherein the increasing temperature and humidity in the drying is performed by supplying steam generated at the steam generator to the washing compartment.

13. The controlling method of claim 12, wherein the steam is supplied to the washing compartment by the steam generator until the temperature of the air inside the washing compartment is between 63° C. and 67° C. in the drying.

* * * * *